US010822568B2

(12) United States Patent
Yoshida et al.

(10) Patent No.: US 10,822,568 B2
(45) Date of Patent: Nov. 3, 2020

(54) FOREIGN SUBSTANCE REMOVING LUBRICANT COMPOSITION, FOREIGN SUBSTANCE REMOVING LUBRICANT COMPOSITION APPLIED MEMBER, AND METHOD FOR USING FOREIGN SUBSTANCE REMOVING LUBRICANT COMPOSITION

(71) Applicant: NIPPECO LTD., Chuo-ku, Tokyo (JP)

(72) Inventors: Yoshiro Yoshida, Chiba (JP); Yousuke Kimura, Chiba (JP)

(73) Assignee: NIPPECO LTD., Tokyo (JP)

( * ) Notice: Subject to any disclaimer, the term of this patent is extended or adjusted under 35 U.S.C. 154(b) by 121 days.

(21) Appl. No.: 16/072,730

(22) PCT Filed: Jan. 26, 2017

(86) PCT No.: PCT/JP2017/002621
§ 371 (c)(1),
(2) Date: Jul. 25, 2018

(87) PCT Pub. No.: WO2017/131059
PCT Pub. Date: Aug. 3, 2017

(65) Prior Publication Data

US 2019/0024006 A1 Jan. 24, 2019

(30) Foreign Application Priority Data

Jan. 27, 2016 (JP) ..... 2016-013501
Mar. 1, 2016 (JP) ..... 2016-039081

(51) Int. Cl.
*C10M 131/10* (2006.01)
*C10M 147/00* (2006.01)
(Continued)

(52) U.S. Cl.
CPC ..... *C10M 131/10* (2013.01); *C10M 101/04* (2013.01); *C10M 107/02* (2013.01);
(Continued)

(58) Field of Classification Search
CPC . C10M 131/10; C10M 131/12; C10M 147/04
(Continued)

(56) References Cited

U.S. PATENT DOCUMENTS 3,637,791 A * 1/1972 Pittman ..... C07C 31/40 558/54
4,213,870 A * 7/1980 Loran ..... G03C 11/06 15/104.94
(Continued)

FOREIGN PATENT DOCUMENTS

JP S47-42805 Y1 12/1972
JP S52-133472 A 11/1977
(Continued)

OTHER PUBLICATIONS

International Search Report issued with respect to Patent Application No. PCT/JP2017/002621, dated Mar. 21, 2017.
(Continued)

*Primary Examiner* — Ellen M McAvoy
(74) *Attorney, Agent, or Firm* — Greenblum & Bernstein, P.L.C.

(57) ABSTRACT

The object of the present invention is to provide a foreign substance removing lubricant composition having high foreign substance removing effects and being capable of improving the lubricating properties as compared to conventional lubricant compositions, a foreign substance removing lubricant composition applied member, and a method for using the foreign substance removing lubricant composition. The foreign substance removing lubricant composition of the present invention comprises a perfluo-
(Continued)

roalkyl group containing compound (S) having a perfluoroalkyl group or a fluoropolyether containing compound. As a result, foreign substance removing effects can be enhanced, and the lubricating properties can be improved as compared to the conventional lubricant compositions.

12 Claims, 12 Drawing Sheets

(51) Int. Cl.

| | |
|---|---|
| ***C10M 101/04*** | (2006.01) |
| ***C10M 107/02*** | (2006.01) |
| ***C10M 125/26*** | (2006.01) |
| ***C10M 145/14*** | (2006.01) |
| ***C10M 147/04*** | (2006.01) |
| *C10N 10/04* | (2006.01) |
| *C10N 10/06* | (2006.01) |
| *C10N 20/02* | (2006.01) |
| *C10N 20/04* | (2006.01) |
| *C10N 20/06* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 50/10* | (2006.01) |

(52) U.S. Cl.
CPC ..... *C10M 125/26* (2013.01); *C10M 145/14* (2013.01); *C10M 147/00* (2013.01); *C10M 147/04* (2013.01); *C10M 2201/1036* (2013.01); *C10M 2201/1056* (2013.01); *C10M 2203/1006* (2013.01); *C10M 2205/022* (2013.01); *C10M 2205/0285* (2013.01); *C10M 2207/0406* (2013.01); *C10M 2207/1256* (2013.01); *C10M 2207/1285* (2013.01); *C10M 2207/2805* (2013.01); *C10M 2207/289* (2013.01); *C10M 2207/2835* (2013.01); *C10M 2209/084* (2013.01); *C10M 2209/1033* (2013.01); *C10M 2211/06* (2013.01); *C10M 2213/00* (2013.01); *C10M 2213/04* (2013.01); *C10M 2213/06* (2013.01); *C10M 2213/062* (2013.01); *C10M 2213/0626* (2013.01); *C10M 2215/0813* (2013.01); *C10M 2215/1026* (2013.01); *C10M 2215/221* (2013.01); *C10M 2215/28* (2013.01); *C10M 2219/046* (2013.01); *C10M 2229/025* (2013.01); *C10N 2010/04* (2013.01); *C10N 2010/06* (2013.01); *C10N 2020/02* (2013.01); *C10N 2020/04* (2013.01); *C10N 2020/06* (2013.01); *C10N 2030/02* (2013.01); *C10N 2030/04* (2013.01); *C10N 2030/06* (2013.01); *C10N 2030/10* (2013.01); *C10N 2050/10* (2013.01)

(58) Field of Classification Search
USPC ..... 508/406, 504, 582, 459, 533
See application file for complete search history.

(56) References Cited

U.S. PATENT DOCUMENTS

| | | | | |
|---|---|---|---|---|
| 4,497,720 | A * | 2/1985 | Moriga | B29C 33/60 508/406 |
| 4,788,350 | A * | 11/1988 | Lagow | B23K 35/386 228/234.2 |
| 5,120,459 | A * | 6/1992 | Kalota | C07C 43/126 252/68 |
| 5,124,058 | A * | 6/1992 | Corti | C10M 107/38 508/509 |
| 5,154,845 | A * | 10/1992 | Williams | C10M 169/04 508/545 |
| 5,605,957 | A | 2/1997 | Yoshida | |
| 5,839,311 | A * | 11/1998 | Grenfell | C10M 105/54 72/42 |
| 6,403,539 | B1 * | 6/2002 | Marchionni | C08G 65/007 508/388 |
| 7,700,527 | B2 * | 4/2010 | Fang | C10M 147/04 508/458 |
| 2003/0148896 | A1 * | 8/2003 | Akiyama | C10M 169/02 508/182 |
| 2005/0075250 | A1 * | 4/2005 | MaCcone et al. | C10M 169/02 508/182 |
| 2007/0049502 | A1 * | 3/2007 | Howell | C08G 65/007 508/182 |
| 2015/0246875 | A1 * | 9/2015 | Friedrich | C07C 309/17 514/785 |
| 2016/0137947 | A1 * | 5/2016 | Isobe | C07F 9/65815 508/548 |

FOREIGN PATENT DOCUMENTS

| | | | |
|---|---|---|---|
| JP | S63-57693 | A | 3/1988 |
| JP | H03-149296 | A | 6/1991 |
| JP | H05-320682 | A | 12/1993 |
| JP | H07-18286 | A | 1/1995 |
| JP | H08-81690 | A | 3/1996 |
| JP | H11-012587 | A | 1/1999 |
| JP | 2005-247998 | A | 9/2005 |
| JP | 2006-77091 | A | 3/2006 |
| JP | 2007-297422 | A | 11/2007 |
| JP | 2008-38047 | A | 2/2008 |
| JP | 2008-239700 | A | 10/2008 |
| JP | 2008-297519 | A | 12/2008 |
| JP | 2010-163558 | A | 7/2010 |
| JP | 2010-195926 | A | 9/2010 |
| JP | 2011-132503 | A | 7/2011 |
| JP | 2016-69590 | A | 5/2016 |

OTHER PUBLICATIONS

International Preliminary Report on Patentability issued with respect to Patent Application No. PCT/JP2017/002621, dated Jul. 31, 2018.

* cited by examiner

FOREIGN SUBSTANCE REMOVING LUBRICANT COMPOSITION, FOREIGN SUBSTANCE REMOVING LUBRICANT COMPOSITION APPLIED MEMBER, AND METHOD FOR USING FOREIGN SUBSTANCE REMOVING LUBRICANT COMPOSITION

TECHNICAL FIELD

The present invention relates to a foreign substance removing lubricant composition, a foreign substance removing lubricant composition applied member, and a method for using the foreign substance removing lubricant composition.

BACKGROUND ART

Lubricant oils or greases are used for automobile parts such as door lock mechanisms, window regulators, seat rails and sunroofs, and members having sliding parts in various devices.

By the way, when foreign substances such as dust and sand are mixed into a lubricant oil or grease, wear of a sliding member is accelerated, and in some cases, abnormal noise develops causing problems.

CITATION LIST

Patent Literature

Patent Literature 1: Japanese Unexamined Patent Application Publication No. 2008-38047

SUMMARY OF INVENTION

Technical Problem

As prior art, for example, it is known that lubricity can be improved with a grease composition with highly crosslinked resin added (see Patent Literature 1).

However, the grease composition with highly crosslinked resin added does not have any features of removing foreign substances such as dust and sand, and therefore wear and noise cannot be suppressed.

The present invention has been made in view of the above problems, and is intended to provide a foreign substance removing lubricant composition having high foreign substance removing effects, and being capable of improving lubricity compared to conventional lubricants, a foreign substance removing lubricant composition applied member and a method of using the foreign substance removing lubricant composition.

Solution to Problem

The foreign substance removing lubricant composition of the present invention is characterized by containing a perfluoroalkyl group containing compound having a perfluoroalkyl group.

Moreover, the foreign substance removing lubricant composition of the present invention is characterized by containing a fluoropolyether containing compound.

Moreover, the foreign substance removing lubricant composition applied member of the present invention is characterized in that the foreign substance removing lubricant composition mentioned above is applied on a member, and the member is placed in an environment containing dust.

Moreover, the method for using the foreign substance removing lubricant composition of the present invention is characterized in that the foreign substance removing lubricant composition mentioned above is applied on a member, and the member is used in an environment containing dust.

Advantageous Effects of Invention

The foreign substance removing lubricant composition of the present invention can have the foreign substance removing effects enhanced by containing a perfluoroalkyl group containing compound having a perfluoroalkyl group, or a fluoropolyether containing compound, and can improve lubricity compared to conventional lubricants.

DESCRIPTION OF EMBODIMENTS

Hereinafter, an embodiment of the present invention (hereinafter abbreviated as "the embodiment") will be described in detail. It should be noted that the present invention is not limited to the following embodiments, and can be exploited with various modifications within the scope of the aspects thereof.

The inventors of the present invention have combined various additives to lubricant oils or greases and tested their lubricity when foreign substances such as dust and sand are contained for automobile parts such as a door lock mechanism, window regulator, seat rail and sunroof, and members having sliding parts in various devices.

As a result, regarding solid lubricants, physical contact is generally prevented with a solid (wear), and impact mitigation is brought about by reducing friction by a rolling action or an intermolecular sliding action and with a solid. However, occurrence of wear and abnormal noise could not be suppressed, and lubricity when foreign substances are mixed could not be dramatically improved. Moreover, although a detergent dispersant having an action to remove sludge exhibited effects of dispersing foreign substances, the occurrence of wear and abnormal noise could not be suppressed, and lubricity when foreign substances are mixed could not be dramatically improved.

Lubricant Composition Containing Perfluoroalkyl Group Containing Compound

As such, the inventors of the present invention conducted intensive research on a foreign substance removing lubricant composition, and consequently discovered that lubricity could be effectively improved compared to that of conventional lubricants by using a lubricant composition containing perfluoroalkyl group containing compound.

The foreign substance removing lubricant composition of the embodiment is characterized by containing a perfluoroalkyl group containing compound having a perfluoroalkyl group.

The mechanism of removing foreign substances when using a foreign substance removing lubricant composition containing a perfluoroalkyl group containing compound is presumed to be as follows.

Figure 1:
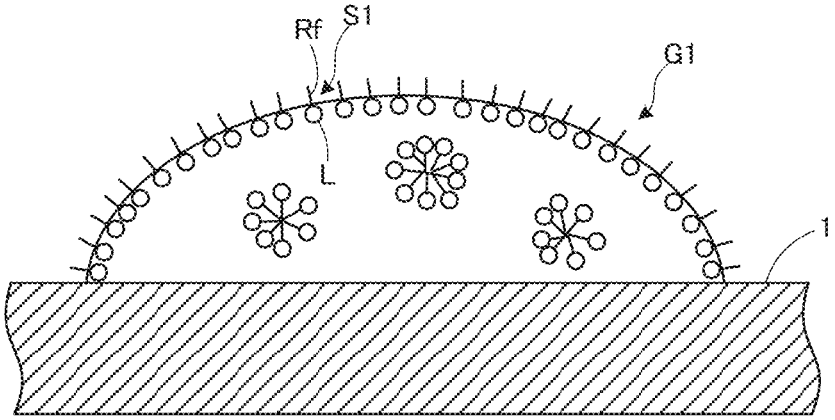
FIG. 1 is a schematic view showing a behavior of a perfluoroalkyl group containing compound in grease.

FIG. 1 is a schematic view showing a behavior of a perfluoroalkyl group containing compound in grease. As shown in FIG. 1, the perfluoroalkyl group containing compound S1 contained in grease G1 as a foreign substance removing lubricant composition has, for example, a perfluoroalkyl group Rf and a lipophilic group L. The lipophilic group L has a higher affinity to oil than the perfluoroalkyl group Rf. The lipophilic group L is charged with δ+, and the perfluoroalkyl group Rf is charged with δ−. This is because the perfluoroalkyl group Rf contains a fluorine element and is polarized to δ− from the electronegativity.

Since the affinity of the perfluoroalkyl group Rf to grease (lubricant oil) is smaller than that of the lipophilic group L, the perfluoroalkyl group Rf is likely to be arranged outward from the grease surface as shown in FIG. 1. Although not shown in the drawings, the perfluoroalkyl group Rf is also arranged on the member side having a coating surface 1 on which the grease G1 is coated. Moreover, inside the grease, in order to keep the surface energy as small as possible, the grease is arranged in a micelle structure having the perfluoroalkyl group Rf arranged in the inside and the lipophilic group L on the outside.

Figure 2:
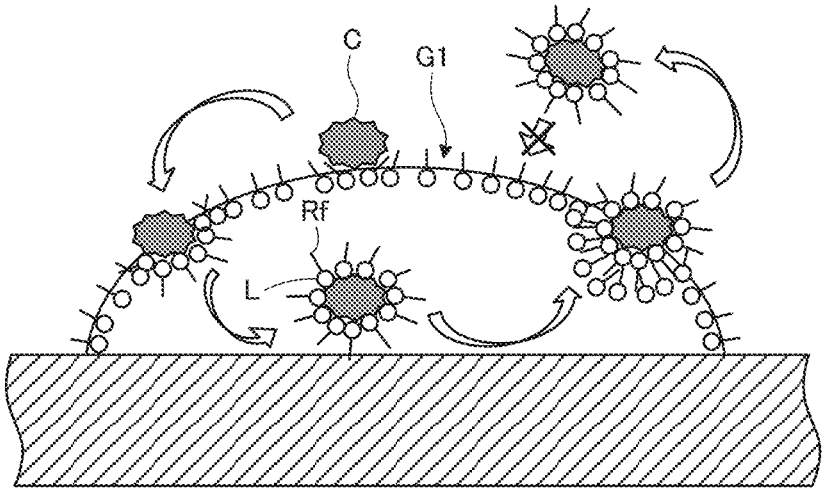
FIG. 2 is a schematic view showing a behavior of a perfluoroalkyl group containing compound in grease mixed with foreign substances.

FIG. 2 is a schematic diagram showing a behavior of a perfluoroalkyl group containing compound in grease mixed with a foreign substance. FIG. 2 shows a state where a foreign substance C is mixed in the grease G1. For example, the foreign substance C has $SiO_2$ as a main component, and the surface of the foreign substance C is polarized to δ−. Therefore, as shown in FIG. 2, the lipophilic group (δ+) L is adsorbed to the foreign substance C so as to be electrically neutralized. Therefore, the perfluoroalkyl group Rf is arranged on the outside of the foreign substance C (the side opposite to the adsorption side). The foreign substance C of which the perfluoroalkyl group Rf is arranged outside has a small affinity to the grease G1. As a result, the foreign substance C is in a state so as to be floating in the grease G1, and an action to be shifted towards the surface of the grease G1 results (shown in FIG. 2 by arrows). Thereby, the foreign substance C is put in a state where the foreign substance C is likely to be removed to the outside of the grease G1. Then, the foreign substance C removed from the grease G1 will be in a state having its outer periphery covered with the perfluoroalkyl group Rf having low affinity to the grease G1, which makes it difficult to be mixed in the grease G1 (see the "x" sign in FIG. 2).

The above-mentioned foreign substance removing action is particularly effective, for example, when members are in a sliding relationship such as a rail trach and a slider moving a long distance. In other words, even a semi-solid grease is fluidized by sliding, and a foreign substance covered with a perfluoroalkyl group (see FIG. 2) quickly moves to the surface of the grease and is easily discharged to the outside. Moreover, the perfluoroalkyl group containing compound itself forms a coating film on the surface contacting a sliding surface, so that lubricity can be more effectively imparted to the foreign substance removing lubricant composition.

In the present embodiment, the perfluoroalkyl group containing compound is preferably contained in the range of 0.01 parts by weight or more and 10 parts by weight or less when the amount of the foreign substance removing lubricant composition is set to be 100 parts by weight. When the content of the perfluoroalkyl group containing compound is less than 0.01 parts by weight, the foreign substance removing effect is reduced and the effect of improving lubricity is insufficient. Moreover, when the content of the perfluoroalkyl group containing compound exceeds 10 parts by weight, the content of the perfluoroalkyl group containing compound in the foreign substance removing lubricant composition is too large, and the original lubricating performance of the lubricant composition decreases. Moreover, even if the content of the perfluoroalkyl group containing compound is increased beyond 10 parts by weight, further improvements in an intended objective corresponding to the content cannot be obtained, and the cost rises which is not practical. Moreover, it is more preferable that the perfluoroalkyl group containing compound is contained in a range of 0.05 parts by weight or more and 10 parts by weight or less.

Perfluoroalkyl Group Containing Compound

In the present embodiment, for example, the following perfluoroalkyl group containing compound can be presented.

That is, in the present embodiment, a perfluoroalkyl group containing compound represented by the following general formula (1) can be contained.

$$Rf—X—Y \quad (1)$$

Provided however that Rf is a perfluoroalkyl group having a carbon number of C2 to C6, X is a compound as a linking group having at least any one of ethylene oxide ($C_2H_4O$), carbonyl (COO), and sulfonyl ($SO_3$), and Y is a compound having a hydrophilic group or a lipophilic group.

The lipophilic group is, for example, C8 to C18 linear alkyl, C8 to C18 branched alkyl, C6 to C16 alkylbenzene, alkylnaphthalene, C4 to C9 perfluoroalkyl, polypropylene oxide H—[OCH($CH_3$)$CH_2$]n-OH, polysiloxane H—[OSi($CH_3$)$_2$]n-OH and the like.

Moreover, the hydrophilic group may be an ionic type, nonionic type, or amphoteric type, and an ionic type may be, for example, carboxyl group-$CO_2$—, sulfate-$OSO_3$—, sulfonate-$SO_3$—, pyridinium-$N^+R$, quaternary ammonium $R_4N^+$ and the like. Moreover, a nonionic type may be, for example, fatty acid-$CO_2H$, primary alcohol-$CH_2OH$, secondary alcohol-CRHOH, tertiary alcohol-$CR_2OH$, ether-COC—, polyethylene oxide-$[OCH_2CH_2]n$-OH and the like. Moreover, examples of an amphoteric type include amine oxide-NHCO, amino acid-$N^+(R')_2RCO_2$ and the like.

The hydrophilic group or the lipophilic group can be used alone or in combination of two or more kinds. The amount of the hydrophilic group or lipophilic group used is not particularly limited and the amount can be selected according to the application suitability.

Alternatively, a perfluoroalkyl group containing oligomer compound composed of a basic skeleton of methacrylic acid represented by the following general formula (2), acrylic acid represented by the following general formula (3), and a copolymer thereof can be contained.

(2)

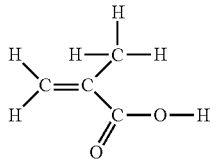

(3)

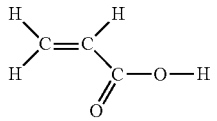

Or, a perfluoroalkyl group containing compound represented by the following general formula (4) may be contained.

(4)

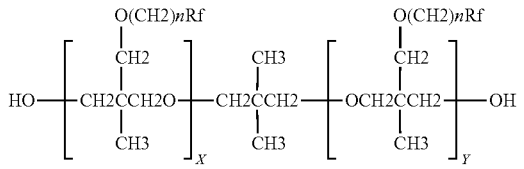

wherein n is an integer 1-2, Rf is a perfluoroalkyl group with a carbon number of 2-4, X and Y are integers greater than or equal to 1, and X+Y is an integer of 4-20.

The above mentioned perfluoroalkyl group containing compounds may be used alone or in combination of two or more. At this time, the mixing ratio and usage are not limited, and can be appropriately adjusted according to the coating suitability.

By the way, in the perfluoroalkyl group containing compound, perfluorooctanoic acid and perfluorooctane sulfonic acid are generally used as raw materials and intermediates in the production stage. Moreover, these perfluorooctanoic acid and perfluorooctane sulphonic acid are also produced when the perfluoroalkyl group containing compound is thermally decomposed. Since these perfluorooctane sulfonic acid and perfluorooctanoic acid are extremely stable in the environment, self-regulations prohibiting production and use thereof are imposed on related enterprises from the perspective of environmental preservation. Therefore, it is preferable to use perfluoroalkyl group containing compounds not containing perfluorooctanoic acid and perfluorooctane sulfonic acid, which are subject to regulations, including raw materials and intermediates, and decomposition products thereof at the manufacturing stage. Specifically, it is preferable that the perfluoroalkyl group has 6 or less carbon atoms.

Lubricant Compositions Containing Fluoropolyether Containing Compound

The inventors of the present invention have further conducted intensive research on the foreign substance removing lubricant composition, and as a result found that by using a lubricant composition containing a fluoropolyether containing compound, lubricity can be improved more effectively compared to conventional methods.

The foreign substance removing lubricant composition of the present embodiment is characterized by containing a fluoropolyether containing compound. The fluoropolyether containing compound is included as a basic skeleton. The basic skeleton means a repeating unit, and includes one in a state of a portion of the fluoropolyether containing compound being substituted with another substituent. "Fluoro" refers to a state in which at least a portion of hydrogen atoms bonded to carbon atoms are substituted with fluorine atoms, and "fluoro" also includes the case of "perfluoro" where all hydrogen atoms are substituted with fluorine atoms.

The mechanism of foreign substance removal, when using a foreign substance removing lubricant composition containing a fluoropolyether containing compound, is presumed to be as follows.

Figure 3:
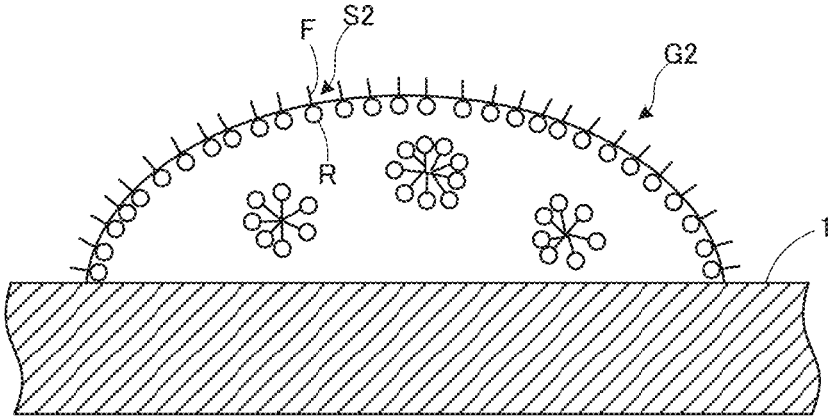
FIG. 3 is a schematic view showing a behavior of a fluoropolyether containing compound in grease.

FIG. 3 is a schematic view showing a behavior of a fluoropolyether containing compound in grease. As shown in FIG. 3, the fluoropolyether containing compound S2 contained in grease G2 as the foreign substance removing lubricant composition has the highest electronegativity of a fluorine atom F, and therefore is charged to δ−, and the functional group R is charged to δ+.

Since the affinity of the fluorine atom F to grease (lubricant oil) is smaller than that of the functional group R, the fluorine atom F is likely to be arranged outward from the grease surface as shown in FIG. 3. Although not shown in the drawings, the fluorine atom F is also arranged on the member side having the coating surface 1 to which the grease G2 is applied. Moreover, inside the grease, in order to keep the surface energy as small as possible, the grease is arranged in a micelle structure having the fluorine atom F arranged on the inside and the functional group R on the outside.

Figure 4:
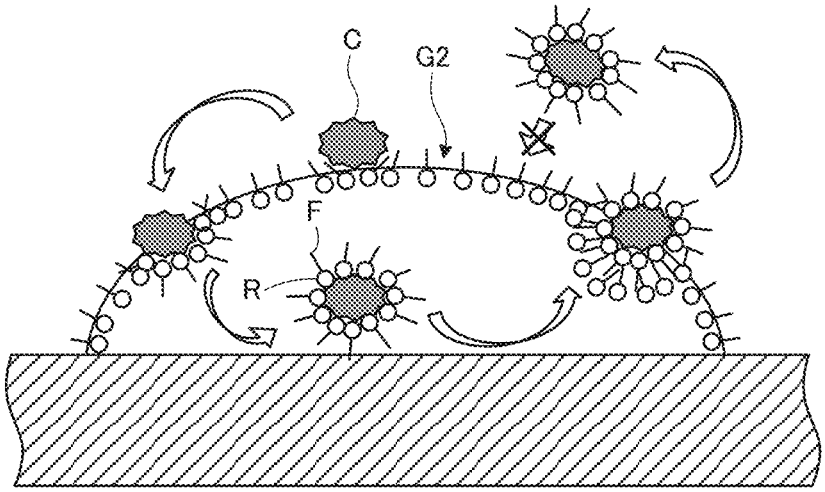
FIG. 4 is a schematic view showing a behavior of a fluoropolyether containing compound in grease mixed with foreign substances.

FIG. 4 is a schematic view showing a behavior of a fluoropolyether containing compound in grease mixed with a foreign substance. FIG. 4 shows a state where the foreign substance C is mixed in the grease G2. The foreign substance C, for example, has $SiO_2$ as a main component, and the surface of the foreign substance C is polarized to δ−. Therefore, as shown in FIG. 4, a functional group (δ+) R is adsorbed on the foreign substance C so as to be electrically neutralized. Therefore, the fluorine atom F is arranged outside the foreign substance C (the side opposite to the adsorption side). The foreign substance C having fluorine atoms F arranged outside has a small affinity to the grease G2. As a result, the foreign substance C is in a state of being suspended in the grease G2 and has an action to move toward the surface of the grease G2 (indicated by the arrow in FIG. 4). As a result, the foreign substance C is in a state to be removed to the outside of the grease G2. Then, the foreign substance C removed from the grease G2 will be in a state having its outer periphery covered with the fluorine atoms F having low affinity to the grease G12, which makes it difficult to be mixed in the grease G2 (see the "x" sign in FIG. 4).

The above mentioned foreign substance removing action is particularly effective, for example, when the members are in a sliding relationship such as a rail track and a slider in which members move long distances. In other words, even semi-solid grease is fluidized by sliding, and a foreign substance covered with fluorine atoms Fa (see FIG. 4) quickly moves to the surface of the grease and is easily discharged to the outside. Moreover, since the fluoropolyether containing compound itself forms a coating film on the surface in contact with the sliding surface, it is possible to more effectively impart lubricity to the foreign substance removing lubricant composition.

In the present embodiment, the fluoropolyether containing compound is preferably contained in a range of 0.01 parts by weight or more and 10 parts by weight or less when the content of the foreign substance removing lubricant composition is set to be 100 parts by weight. When the content of the fluoropolyether containing compound is less than 0.01 parts by weight, the foreign substance removing effect is reduced and the effect of improving lubricity is insufficient. Moreover, when the content of the fluoropolyether containing compound exceeds 10 parts by weight, the content of the fluoropolyether containing compound in the foreign substance removing lubricant composition is too large causing the original lubricating performance of the lubricant composition decreases. Moreover, even if the content of the fluoropolyether containing compound is increased beyond 10 parts by weight, further improvements in an intended objective corresponding to the content cannot be obtained, and the cost rises which is not practical. Moreover, it is more preferable that the fluoropolyether containing compound is contained in the range of 0.05 parts by weight or more and 10 parts by weight or less.

Fluoropolyether Containing Compound

In the present embodiment, for example, the following fluoropolyether containing compound can be presented.

That is, in the present embodiment, a fluoropolyether containing compound represented by the following general formula (5) or (6) can be contained.

$$X—CF_2O—(CF_2CF_2O)_m—(CF_2O)_n—CF_2—X \quad (5)$$

$$X—CF_2O—(CF_2CF(CF_3)O)_m—(CF_2O)_n—CF_2—X \quad (6)$$

wherein, $3 \leq m+n \leq 500$, m:n=(10–90):(90–10), one or both of X is/are functional group(s), and when a functional group X is linked to one of the terminals, X on the other terminal is fluorine (F), and the functional group is a compound having at least any one of carboxylate, alkyl amide, carboxylate triethanolamine, dinitrobenzene, alcohol, methyl ester, ethoxylated alcohol, alkyl amide, polyamide, alkoxy silane, phosphate, urethane methacrylate and urethane alkylate.

Further, in the case where both Xs are functional groups, the functional groups X may be the same or different, but are usually the same. The above mentioned fluoropolyether containing compound can be used alone or in combination of two or more thereof. At this time, the mixing ratio and the amount of use are not limited, and can be appropriately adjusted according to the coating suitability.

Moreover, the viscosity (20° C.) of the fluoropolyether containing compound is in the order of 50 cSt to 30,000 cSt.

Lubricant Oil Types and Grease Types

The foreign substance removing lubricant composition of the present embodiment is characterized by containing a perfluoroalkyl group containing compound or a fluoropolyether containing compound, and lubricant components of a lubricant oil or grease. That is, the lubricant oil type includes a perfluoroalkyl group containing compound or a fluoropolyether containing compound, and a lubricant oil as a lubricating component. Moreover, the grease type includes a perfluoroalkyl group containing compound or a fluoropolyether containing compound, and a base oil and a thickener as lubricant components. Here, both the perfluoroalkyl group containing compound and the fluoropolyether containing compound may be contained.

Contents of the perfluoroalkyl group containing compound and the fluoropolyether containing compound and the amount of lubricant components may be appropriately adjusted depending on the intended use, within the range of 0.01 parts by weight to 10 parts by weight for the perfluoroalkyl group containing compound and the fluoropolyether containing compound.

The lubricant component is preferably selected from at least any one of mineral oil, synthetic hydrocarbon oil, diester oil, polyol ester oil, ether oil, glycol oil, silicone oil, and fluorine oil. These lubricant components can be used alone or in combination of two or more kinds, and their amounts to be used are not particularly limited, and the amounts can be selected depending on the application suitability. Poly-α-olefin and ethylene-α-olefin oligomer are particularly preferred as the lubricant component, because they can be used in a wide temperature range, and have compatibility with rubber/resin, and compatibility with additives.

The thickener contained in the grease of the present embodiment is preferably selected from at least any one of lithium soap, calcium soap, sodium soap, aluminum soap, lithium complex soap, calcium composite soap, aluminum complex soap, urea compound, organified bentonite, polytetrafluoroethylene, silica gel, sodium terephthalamate. On the basis of shear stability, the thickener is preferably lithium stearate, and/or 12-lithium hydroxystearate. The lithium soap is a saponification reaction product of fatty acid or its derivative with lithium hydroxide. The fatty acid used is at least one selected from the group consisting of saturated or unsaturated fatty acids and derivatives thereof having a carbon number of 2 to 22. Moreover, "Soap" obtained by reacting the fatty acid or its derivative with lithium hydroxide is commercially available, and it can also be used.

Moreover, depending on needs, an antioxidant, rust inhibitor, metal corrosion inhibitor, oily agent, antiwear agent, extreme pressure agent, solid lubricant and the like can be added. The contents of these additives fall within the range in the order of 0.01 parts by weight to 30 parts by weight. The antioxidant can be selected from hindered phenol, alkylated diphenylamine, phenyl-α-naphthylamine and the like. The rust inhibitor can be selected from a carboxylic acid such as stearic acid, dicarboxylic acid, metal soap, carboxylic acid amine salt, metal salt of heavy sulfonic acid, carboxylic acid partial ester of polyhydric alcohol or the like. The metal corrosion inhibitor can be selected from benzotriazole, benzimidazole or the like. The oily agent can be selected from amines such as laurylamine, higher alcohols such as myristyl alcohol, higher fatty acids such as palmitic acid, fatty acid esters such as methyl stearate, amides such as oleylamide or the like. The antiwear agent can be selected from zinc, sulfur, phosphorus, amine, ester or the like. The extreme pressure agent can be selected from zinc dialkyl dithiophosphate, molybdenum dialkyl dithiophosphate, sulfurized olefin, sulfurized fat and oil, methyl trichlorostearate, chlorinated naphthalene, benzyl iodide, fluoroalkyl polysiloxane, lead naphthenate or the like. Moreover, the solid lubricant can be selected from graphite, fluorinated graphite, polytetrafluoroethylene, melamine cyanurate, molybdenum disulfide, antimony sulfide and the like.

Foreign Substance Removing Effects

In the present embodiment, the foreign substance is not particularly limited, but it may, for example, be mainly composed of $SiO_2$ (silicon dioxide). $SiO_2$ has a crystal structure where $SiO_4$ tetrahedra, each having $Si_4^+$ at the center and being surrounded by 4 $O_2$s in the periphery, are continuously linked to form a crystal. The electronegativity of S1 is 1.8, and the electronegativity of O is 3.5, and there is a difference in electronegativity of 1.7 between the two. Therefore, $SiO_2$ is polarized to negative (δ—).

In this embodiment, as will be described in detail in the experiments described below, foreign substances having at least type-7 or type-8 prescribed in JIS Z 8901 were added to a foreign substance removing lubricant composition (a lubricant oil type) comprising a perfluoroalkyl group containing compound, or a fluoropolyether containing compound, and a lubricant oil. Type-7 and type-8 prescribed in JIS Z 8901 both contain $SiO_2$ as main component. Even if foreign substances were mixed in, the sedimentation of foreign substances was observed in the lubricant oil of the embodiment. Namely, in the foreign substance removing lubricant composition of the present embodiment, the foreign substances were not incorporated into the lubricant composition, and the foreign substance removing effect was confirmed.

Moreover, as will be described in detail in the experiments described below, foreign substances having at least type-1 or type-2 prescribed in JIS Z 8901 were added to a foreign substance removing lubricant composition (a grease) comprising a perfluoroalkyl group containing compound, or a fluoropolyether containing compound, and a lubricant component of a grease, and the friction coefficient was measured. As a result, it was found that the grease of the present embodiment does not contain the perfluoroalkyl group containing compound and that the friction coefficient is smaller than the friction coefficient of the conventional lubricant composition with foreign substances added. Type-1 and type-2 prescribed in JIS Z 8901 both contain $SiO_2$ as main component.

Moreover, as will be described in detail in the experiments described below, foreign substances having at least type-1 or type-2 prescribed in JIS Z 8901 were added to a foreign substance removing lubricant composition (grease) comprising a perfluoroalkyl group containing compound, and a lubricant component of grease, and an initial friction coefficient μ1 was measured. Moreover, the initial friction coefficient μ0 in a state of adding no foreign substances was also measured. The change rate (%) of the friction coefficient indicated by $\{(\mu1-\mu0)/\mu0\}\times100$ was determined, and it was found that, in the grease of the present embodiment, the change rate of the friction coefficient at the initial stage was able to be less than 45%. Here, the "initial stage" refers to a sliding condition where the number of reciprocated slides is set to 5 or more and 50 or less. Moreover, in the present embodiment, the change rate is preferably less than 40%, more preferably less than 30%, still more preferably less than 20%.

Moreover, as will be described in detail in the experiments described below, foreign substances having at least type-1 or type-2 prescribed in JIS Z 8901 were added to a foreign substance removing lubricant composition (grease) comprising a fluoropolyether containing compound, and a lubricant component of a grease, and an initial friction coefficient μ1 was measured. Moreover, the initial friction coefficient μ0 in a state of adding no foreign substances was also measured. The change rate (%) of the friction coefficient indicated by $\{(\mu1-\mu0)/\mu0\}\times100$ was determined, and it was found that, in the grease of the present embodiment, the change rate of the friction coefficient at the initial stage was able to be less than 40%. Here, the "initial stage" refers to a sliding condition in which the number of reciprocated slides is set to 5 or more and 50 or less. Moreover, in the present embodiment, the change rate is more preferably less than 30%, further preferably less than 20%.

By using the foreign substance removing lubricant composition of the present embodiment, when the foreign substance removing lubricant composition is applied to the lubricating surface and the sliding member is slid, due to the foreign substance removing effect, the friction coefficient can be kept in a state of being low and stable. Therefore, by using the foreign substance removing lubricant composition of the present embodiment, it is possible to obtain a stable and high lubricity compared to the conventional composition, As shown in an experiment to be described later, by using a foreign substance obtained by mixing at least two types at a predetermined ratio from type-1, type-2, type-7 and type-8 prescribed in JIS Z 8901, it is possible to observe sedimentation of foreign substances mentioned above and perform experiments on friction coefficient. The mixing ratio at this time is not particularly limited. For example, as shown in an experiment described later, type-1, type-2, type-7 and type-8 prescribed in JIS Z 8901 can be mixed at a ratio of 1:1:1:1.

The foreign substance removing lubricant composition of the present embodiment can keep high and stable lubricity by foreign substance removing effects even when placed under an environment including dust. "[Being] under an environment including dust" means, for example, being under an environment in which dust is contained at a volume ratio of 50% or less of the foreign substance removing lubricant composition. That is, in the case of the foreign substance removing lubricant composition of the present embodiment, even when dust is included up to about 50% by volume ratio of the foreign substance removing lubricant composition, the foreign substance removing effect can be appropriately exhibited. In the present embodiment, under an environment where dust is included in the volume ratio of the foreign substance removing lubricant composition by about 0.01% or more, it is clear that the conventional lubricant composition is lower in friction coefficient, such that foreign substance removing effects prominently appear.

Moreover, the foreign substance removing lubricant composition of the present embodiment is used as a lubricant oil or grease for automobile parts such as a door lock mechanism, a window regulator, a seat rail, and a sunroof, and members having sliding parts in various devices. Even if such an automobile part and a member having a sliding part are placed in an environment containing dust as described above, by using the foreign substance removing lubricant composition of the present embodiment, the foreign substance removing effect can be appropriately exhibited, and it is possible to stably obtain high lubricity as compared to the conventional composition.

EXAMPLES

Hereinafter, the present invention will be described in detail with reference to examples conducted for clarifying the effects of the present invention. It should be noted that the present invention is not limited by the following examples by any means.

Lubricant Composition Containing Perfluoroalkyl Group Containing Compound

First, an experiment of a lubricant composition containing a perfluoroalkyl group containing compound will be described.

Lubricant Oil Types

Lubricant oils of Examples 1 to 10 and Comparative Examples 1 to 3 as lubricant oil types were prepared with the formulations shown in the following Table 1 and Table 2. The raw materials used are as follows.

Example 1

Fluorine based surfactant A Average molecular weight 4480: 1.0 part by weight

Lubricant oil Poly-α-olefin (kinetic viscosity (40° C.): 30 mm/s): 97.8 parts by weight Antioxidant Hindered phenol based antioxidant (see the following general formula (7)): 0.2 parts by weight (7)

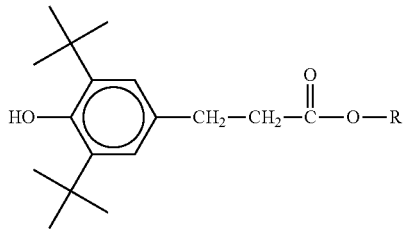

Dust (type-1, type-2, type-7, and type-8 of JIS Z 8901 were mixed at a ratio of 1:1:1:1): 1.0 part by weight

Example 2

Fluorine based surfactant A Average molecular weight 4480: 0.01 parts by weight

Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight

Example 3

Fluorine based surfactant A Average molecular weight 4480: 5.0 parts by weight

Lubricant oil Poly-α-olefin (kinetic viscosity (40° C.): 30 $mm^2$'s): 64.8 parts by weight Antioxidant Hindered phenol based antioxidant: 0.2 parts by weight Dust (type-1, type-2, type-7, and type-8 of JIS Z 8901 were mixed at a ratio of 1:1:1:1): 30.0 parts by weight

Example 4

Fluorine based surfactant B Average molecular weight 1490: 1.0 part by weight

Lubricant oil Poly-α-olefin (kinetic viscosity (40° C.): 30 $mm^2/s$): 97.8 parts by weight Antioxidant Hindered phenol based antioxidant: 0.2 parts by weight Dust (type-2 and type-8 of JIS Z 8901 were mixed at a ratio of 1:1): 1.0 part by weight

Example 5

Fluorine based surfactant C Partially fluorinated alcohol-substituted glycol: 1.0 part by weight Lubricant oil Poly-α-olefin (kinetic viscosity (40° C.): 30 $mm^2$'s): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight

Example 6

Fluorine based surfactant D Perfluoroalkyl trialkylammonium salt (viscosity (25° C.) 6.7 mPa·s): 1.0 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight

Example 7

Fluorine based surfactant E Perfluoroalkyl ethylene oxide adduct (viscosity (25° C.) 430 mPa·s): 1.0 part by weight Lubricant oil Poly α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight

Example 8

Fluorine based surfactant F Perfluoroalkyl containing oligomer (specific gravity (25° C.) 1.26): 1.0 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Example 9

Fluorine based surfactant A Average molecular weight 4480: 0.005 parts by weight Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Example 10

Fluorine based surfactant B Average molecular weight 1490: 0.005 parts by weight Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Comparative Example 1

Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Comparative Example 2

Detergent dispersant A Perbasic metal Ca sulfonate (viscosity (100° C.) 52 cSt): 1 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Comparative Example 3

Detergent dispersant B Succinic acid imide (viscosity (100° C.) 570 cSt): 1 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Here, the fluorine based surfactant A and the fluorine based surfactant B contain the perfluoroalkyl group containing compound according to claim 5 of the Claims originally attached to the application. Moreover, the fluorine based surfactant C, the fluorine based surfactant D. and the fluorine based surfactant E contain the perfluoroalkyl group containing compound according to claim 3 of the Claims originally attached to the application. The fluorine based surfactant F contains the perfluoroalkyl group containing compound according to claim 4 of the Claims originally attached to the application.

In Example 1 to Example 10 and Comparative Example 1 to Comparative Example 3, each raw material was weighed in a screw bottle and was mixed with stirring.

TABLE 1

| | Example 1 | Example 2 | Example 3 | Example 4 | Example 5 | Example 6 |
|---|---|---|---|---|---|---|
| Fluorine based surfactant A | 1.0 | 0.01 | 5.0 | | | |
| Fluorine based surfactant B | | | | 1.0 | | |
| Fluorine based surfactant C | | | | | 1.0 | |
| Fluorine based surfactant D | | | | | | 1.0 |
| Lubricant oil | 97.8 | 98.8 | 64.8 | 97.8 | 97.8 | 97.8 |
| Antioxidant | 0.2 | 0.2 | 0.2 | 0.2 | 0.2 | 0.2 |
| Dust | 1.0 | 1.0 | 30.0 | 1.0 | 1.0 | 1.0 |
| Separation/Sedimentation of Dust | ○ | ○ | ○ | ○ | ○ | ○ |

TABLE 2

| | Example 7 | Example 8 | Example 9 | Example 10 | Comparative Example 1 | Comparative Example 2 | Comparative Example 3 |
|---|---|---|---|---|---|---|---|
| Fluorine based surfactant A | | | 0.005 | | | | |
| Fluorine based surfactant B | | | | 0.005 | | | |
| Fluorine based surfactant E | 1.0 | | | | | | |
| Fluorine based surfactant F | | 1.0 | | | | | |
| Lubricant oil | 97.8 | 97.8 | 98.8 | 98.8 | 98.8 | 97.8 | 97.8 |
| Detergent dispersant A | | | | | | 1.0 | |
| Detergent dispersant B | | | | | | | 1.0 |
| Antioxidant | 0.2 | 0.2 | 0.2 | 0.2 | 0.2 | 0.2 | 0.2 |
| Dust | 1.0 | 1.0 | 1.0 | 1.0 | 1.0 | 1.0 | 1.0 |
| Separation/Sedimentation of Dust | ○ | ○ | Δ | Δ | x | x | x |

The symbol "o" denoted in Table 1 and Table 2 indicates that separation and sedimentation of dust were observed at the bottom of the screw bottle. On the other hand, symbol "A" indicates that although separation and sedimentation of dust were observed at the bottom of the screw bottle, the amount of sedimentation of dust was smaller than that of the examples evaluated as "o" where the same amount of dust was added. Symbol "x" indicates that separation and sedimentation of dust were not observed at the bottom of the screw bottle.

Figure 5:
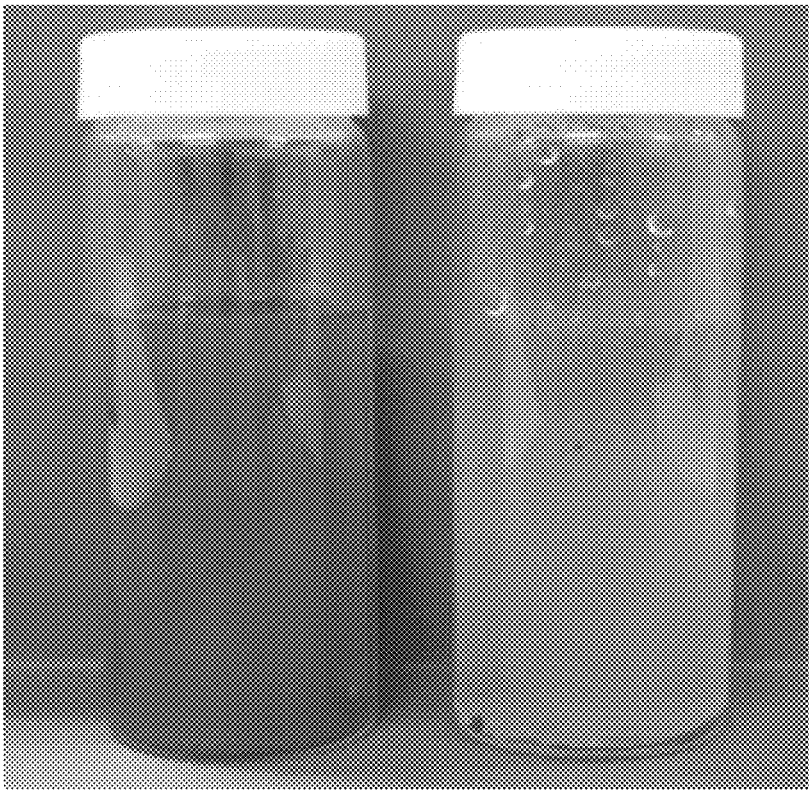
FIG. 5 is a photograph showing a mixed state of foreign substances in each sample of Comparative Example 1 and Example 1.
Figure 6:
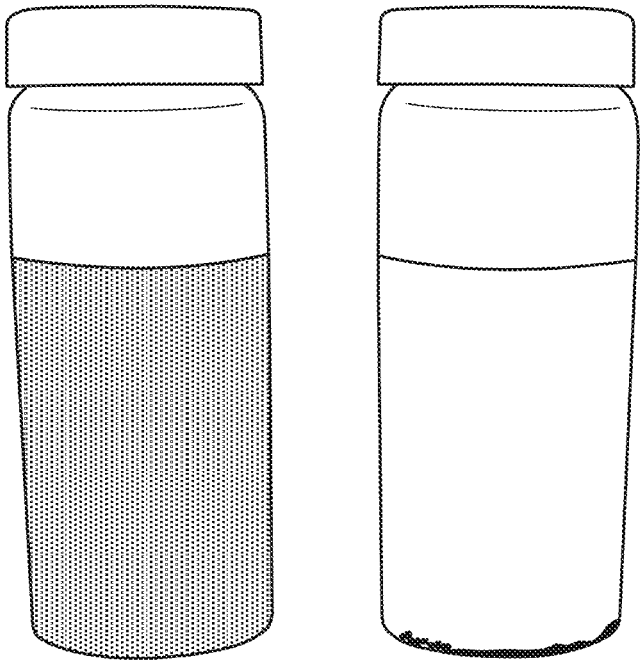
FIG. 6 is a schematic view of FIG. 5.

FIG. 5 is a photograph showing mixed states of foreign substances of each of the samples of Example 1 and Comparative Example 1. FIG. 6 is a schematic diagram of FIG. 5. The photograph and the schematic diagram on the left side in FIG. 5 and FIG. 6, respectively show a case of Comparative Example 1, and the photograph and the schematic diagram on the right side show a case of Example 1. As shown in FIG. 5 and FIG. 6, in Comparative Example 1, it was observed that the entire solution became murky and that foreign substances were not removed. The reason that the solution becomes murky as such is that, among the dust particles in JIS Z 8901, type-7 and type-8 having small particle sizes retain a mixed state within the lubricant oil. On the other hand, as shown in FIG. 5 and FIG. 6, the entire solution in Example 1 was in a translucent state, and it was confirmed that foreign substances were excluded from the lubricant oil and settled at the bottom. In Example 9 and Example 10 where "separation and sedimentation of dust" shown in Table 2 were evaluated as "Δ", the amount of sedimentation of foreign substances was less compared to that of cases evaluate as "o".

Then, each of the samples of Example 1 and Comparative Example 1 mentioned above were applied on a glass plate ($SiO_2$). Next, it was immersed in petroleum benzine and degreased. Thereafter, the petroleum benzine was dried and the surface of the glass plate was observed by SEM-EDX.

Figure 7:
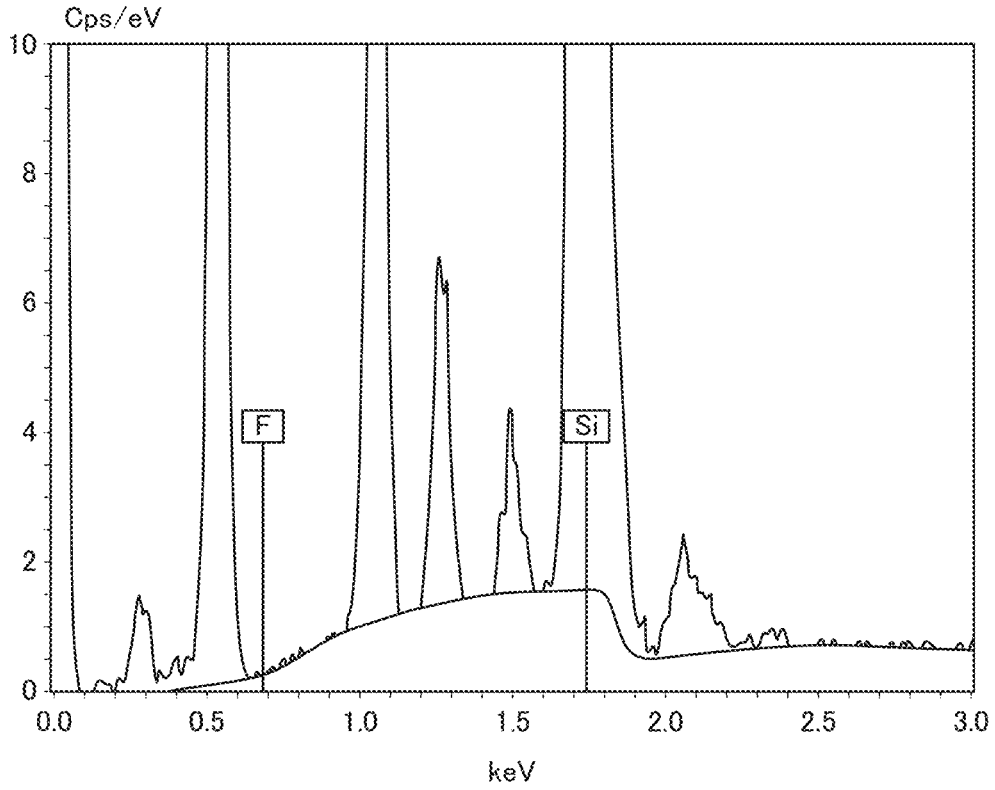
FIG. 7 shows qualitative analysis results of SEM-EDX of Comparative Example 1.
Figure 8:
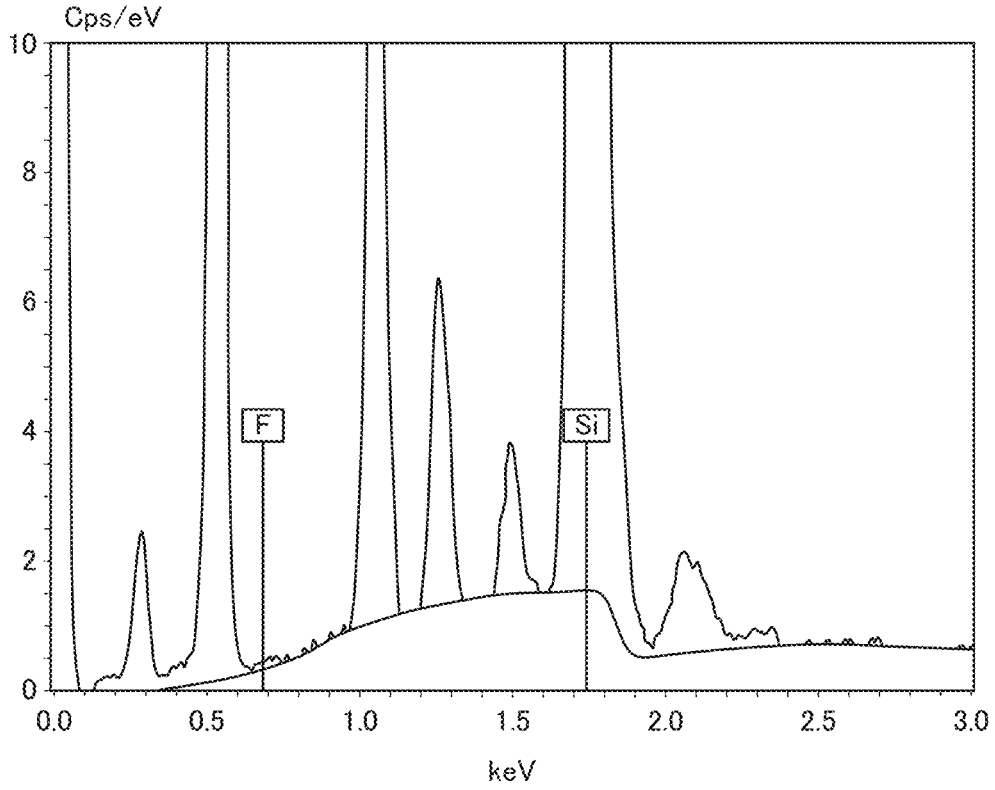
FIG. 8 shows qualitative analysis results of SEM-EDX of Example 1.

FIG. 7 shows qualitative analysis results of SEM-EDX of Comparative Example 1. FIG. 8 shows qualitative analysis results of SEM-EDX of Example 1.

In contrast to Comparative Example 1 in FIG. 7, fluorine was detected in Example 1 by qualitative analysis in FIG. 8, and it was found that fluorine was adsorbed on the glass surface.

Grease Types

Grease types of Example 11 to Example 18 and Comparative Example 4 were prepared with the formulations shown in the following Table 3 and Table 4. Raw materials used are as follows.

Example 11

Fluorine based surfactant A Average molecular weight 4480: 0.5 parts by weight

Base oil Poly-α-olefin (kinetic viscosity (40° C.): 30 $mm^2/s$): 77.3 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 2.0 parts by weight Further, dust was mixed after grease was prepared. The same holds true for the samples below.

Example 12

Fluorine based surfactant A Average molecular weight 4480: 1.0 part by weight

Base oil Poly-α-olefin (kinetic viscosity (40° C.): 30 $mm^2/s$): 76.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 15.0 parts by weight Example 13

Fluorine based surfactant A Average molecular weight 4480: 0.01 parts by weight

Base oil Poly-α-olefin (kinetic viscosity (40° C.): 30 $mm^2/s$): 77.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 2.0 parts by weight Example 14

Fluorine based surfactant A Average molecular weight 4480: 10.0 parts by weight

Base oil Poly-α-olefin (kinetic viscosity (40° C.): 30 $mm^2/s$): 67.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-2 and type-8 of JIS Z 8901 were mixed at a ratio of 1:1): 2.0 parts by weight Example 15

Fluorine based surfactant B Average molecular weight 1490: 1.0 part by weight

Base oil Poly-α-olefin (kinetic viscosity (40° C.): 30 $mm^2$ s): 76.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust was mixed after grease was prepared.

Dust (type-1, type-2, type-7, and type-8 of JIS Z 8901 were mixed at a ratio of 1:1:1:1): 2.0 parts by weight Example 16

Fluorine based surfactant C Partially fluorinated alcohol substituted glycol: 1.0 part by weight Base oil Poly-α-olefin (kinetic viscosity (40° C.): 30 $mm^2/s$): 76.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 2.0 parts by weight Example 17

Fluorine based surfactant A Average molecular weight 4480: 0.005 parts by weight Base oil Poly-α-olefin (kinetic viscosity (40° C.): 30 $mm^2/s$): 77.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 2.0 parts by weight Example 18

Fluorine based surfactant B Average molecular weight 1490: 0.005 parts by weight Base oil Poly-α-olefin (kinetic viscosity (40° C.): 30 $mm^2/s$): 77.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 2.0 parts by weight Comparative Example 4

Base oil Poly-α-olefin (kinetic viscosity (40° C.): 30 $mm^2/s$): 79.8 parts by weight Thickener Lithium soap (12-lithium hydroxystearate): 10.0 parts by weight Antioxidant Hindered phenol based antioxidant: 0.2 parts by weight Solid lubricant D Ultra high molecular weight polyethylene (average particle diameter 10 μm): 10.0 parts by weight Dust (type-1, type-2, type-7, and type-8 of JIS Z 8901 were mixed at a ratio of 1:1:1:1): 2.0 parts by weight In the presence of base oil, lithium soap was synthesized and the temperature was raised with stirring. Then, after cooling to 80° C. or lower, various additives were formulated and a uniform grease composition could be obtained by using a three-stage roll mill, a disper mill, a colloid mill or the like.

Worked penetration was adjusted between 280 and 310. Further, test method was based on JIS K 2220. After adjusting the worked penetration, a prescribed amount of dust was mixed in the grease.

Method for Assessing Grease

Since grease is a viscous substance, it cannot be evaluated by sedimentation of dust as in the case of a lubricant oil. Therefore, grease was assessed with friction coefficient.

Experiment Conditions of Friction Coefficient

Test piece: PA 66 GF 30 pin (ϕ 4 mm)/Al plate

Load: 1000 gf

Grease coating thickness: 0.2 mm

Test temperature: Room Temperature

Sliding speed: 10 mm/sec

Sliding width: 20 mm/one way

Number of slides: 10 reciprocated slides

Figure 9:
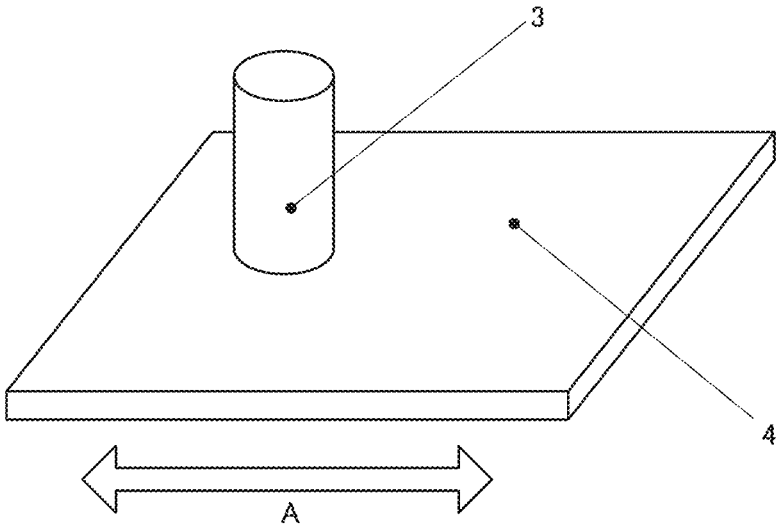
FIG. 9 is a schematic view for explaining a method of a reciprocated sliding test.

FIG. 9 is a schematic diagram for explaining a method of testing reciprocated slides. Reference numeral 3 shown in FIG. 9 denotes a fixing pin, and reference numeral 4 therein denotes an Al plate. Then, the Al plate 4 was slid reciprocatingly in the A direction.

For each sample, the kinetic friction coefficients before and after the addition of dust were measured, and the change rate of the friction coefficient was calculated by the following calculation formula.

That is, the kinetic friction coefficient after mixing dust after performing ten reciprocated slides was set as μ1, and the kinetic friction coefficient before mixing dust after performing ten reciprocated slides was set as μ0. Then, the change rate (%) of the frictional coefficient was obtained by $\{(\mu1-\mu0)/\mu0\}\times100$. The experimental results are shown in Table 3 and Table 4 below.

TABLE 3

| | Example 11 | Example 12 | Example 13 | Example 14 | Example 15 | Example 16 |
|---|---|---|---|---|---|---|
| Fluorine based surfactant A | 0.5 | 1.0 | 0.01 | 10.0 | | |
| Fluorine based surfactant B | | | | | 1.0 | |
| Fluorine based surfactant C | | | | | | 1.0 |
| Base oil | 77.3 | 76.8 | 77.8 | 67.8 | 76.8 | 76.8 |
| Lithium soap | 7.0 | 7.0 | 7.0 | 7.0 | 7.0 | 7.0 |
| Antioxidant | 0.2 | 0.2 | 0.2 | 0.2 | 0.2 | 0.2 |
| Solid lubricant A | 5.0 | 5.0 | 5.0 | 5.0 | 5.0 | 5.0 |
| Solid lubricant B | 5.0 | 5.0 | 5.0 | 5.0 | 5.0 | 5.0 |
| Solid lubricant C | 5.0 | 5.0 | 5.0 | 5.0 | 5.0 | 5.0 |
| Dust | 2.0 | 15.0 | 2.0 | 2.0 | 2.0 | 2.0 |
| Change Rate | | ○ | ○ | | ○ | ○ |

TABLE 4

| | Example 17 | Example 18 | Comparative Example 4 |
|---|---|---|---|
| Fluorine based surfactant A | 0.005 | | |
| Fluorine based surfactant B | | 0.005 | |
| Base oil | 77.8 | 77.8 | 79.8 |
| Lithium soap | 7.0 | 7.0 | 10.0 |
| Antioxidant | 0.2 | 0.2 | 0.2 |
| Solid lubricant A | 5.0 | 5.0 | |
| Solid lubricant B | 5.0 | 5.0 | |
| Solid lubricant C | 5.0 | 5.0 | |
| Solid lubricant D | | | 10.0 |
| Dust | 2.0 | 2.0 | 2.0 |
| Change Rate | Δ | Δ | x |

Here, symbol "◎" denoted in the "Change Rate" column shown in Table 3 and Table 4 indicates that the change rate is less than 30%, symbol "o" indicates that the change rate is 30% or more and less than 40%, symbol "Δ" indicates that the change rate is 40% or more and less than 45%, and symbol "x" indicates that the change rate is 45% or more.

As shown in Table 3 and Table 4, it was found that the change rate of the friction coefficient at the initial stage can be suppressed to less than 45% in the examples. Moreover, in Example 11 to Example 16, it was found that the change rate can be suppressed to less than 40%. Moreover, in Example 11 and Example 14, it was found that the change rate can be suppressed to less than 30%. Here, the friction coefficient was measured after performing reciprocated slides for 10 times. The reason for this is that, in the first several reciprocated slides, a sliding member and grease do not fit in with each other to cause large fluctuations in measurements of friction coefficients.

Next, using each of the samples of Example 11 and Comparative Example 4, the relationship between the number of reciprocated slides and the friction coefficient, when the sliding speed was changed to 1 mm/s and 10 mm/s, was studied. Further, experimental conditions of measuring the friction coefficients were the same except for the number of sliding speed and the number of slides mentioned above.

Figure 10:
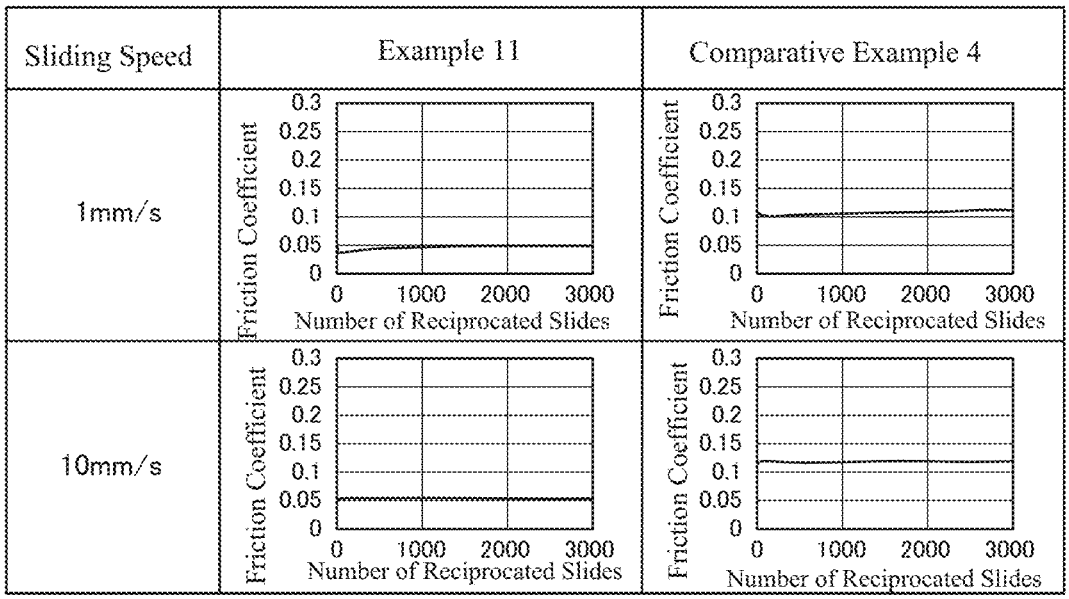
FIG. 10 shows graphs showing relationships between the number of reciprocated slides and the friction coefficient for each sliding speed of Example 11 and Comparative Example 4 in a state not containing foreign substances.

FIG. 10 shows graphs showing relationships between the number of reciprocated slides and the friction coefficient for each sliding speed of Example 11 and Comparative Example 4 in a state not containing foreign substances. On the other hand, FIG. 11 shows graphs showing relationships between the number of reciprocated slides and the friction coefficient for each sliding speed of Example 11 and Comparative Example 4 in a state containing foreign substances.

As shown in FIG. 10, it was found that the friction coefficient does not significantly change depending on the sliding speed in both Example 11 and Comparative Example 4 in a state free of foreign substances, but that the friction coefficient can be suppressed low in Example 11 better than in Comparative Example 4.

Figure 11:
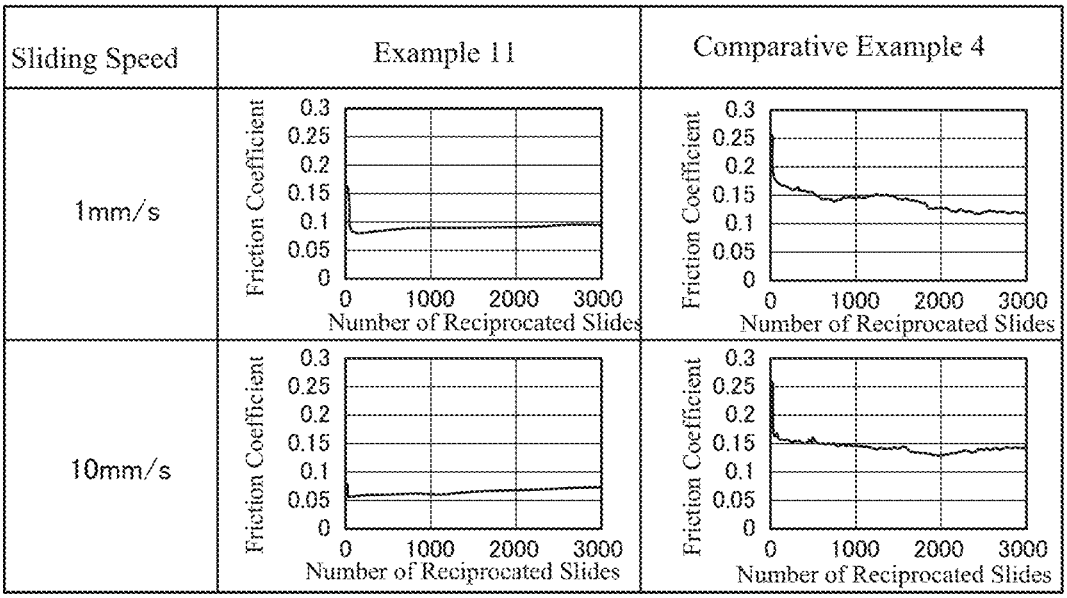
FIG. 11 shows graphs showing the relationships between the number of reciprocated slides and the friction coefficient for each sliding speed of Example 11 and Comparative Example 4 in a state containing foreign substances.

Next, as shown in FIG. 11, it was found that the friction coefficient does not change significantly depending on the sliding speed in Example 11 even in a state containing foreign substances. In contrast, in Comparative Example 4, it was found that the friction coefficient becomes unstable particularly as the sliding speed becomes lower.

Lubricant Composition Containing Fluoropolyether Containing Compound

Next, an experiment on a lubricant composition containing a fluoropolyether containing compound will be described.

Lubricant Oil Types

Lubricant oil types of Example 19 to Example 28, Example 29 to Example 31, Comparative Example 5 to Comparative Example 7, and Comparative Example 8 were prepared with the formulations shown in the following Table 5, Table 6 and Table 7. The raw materials used are as follows.

Example 19

Fluoropolyether containing compound A (product name: Fomblin (registered trademark, hereinafter the same) DA 305): 1.0 part by weight Lubricant oil Poly-α-olefin (kinetic viscosity (40° C.): 30 $mm^2/s$): 97.8 parts by weight Antioxidant Hindered phenol based antioxidant (see general formula (8) below): 0.2 parts by weight (8)

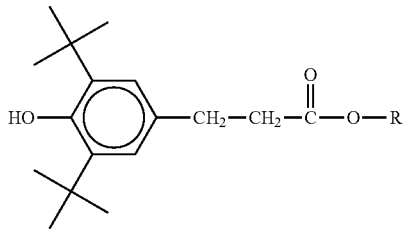

Dust (type-1, type-2, type-7, and type-8 of JIS Z 8901 were mixed at a ratio of 1:1:1:1): 1.0 part by weight Example 20

Fluoropolyether containing compound B (product name: Fomblin DA306 VAC): 1.0 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Example 21

Fluoropolyether containing compound B (product name: Fomblin DA306 VAC): 0.01 parts by weight Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Example 22

Fluoropolyether containing compound B (product name: Fomblin DA306 VAC): 5.0 parts by weight Lubricant oil Poly-α-olefin (kinetic viscosity (40° C.): 30 $mm^2/s$): 64.8 parts by weight Antioxidant Hindered phenol based antioxidant: 0.2 parts by weight Dust (type-1, type-2, type-7, and type-8 of JIS Z 8901 were mixed at a ratio of 1:1:1:1): 30.0 parts by weight Example 23

Fluoropolyether containing compound C (product name: Fomblin DA308): 1.0 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-2 and type-8 of JIS Z 8901 were mixed at a ratio of 1:1): 1.0 part by weight Example 24

Fluoropolyether containing compound D (product name: Fomblin DA410): 1.0 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-2 and type-7 of JIS Z 8901 were mixed at a ratio of 1:1): 1.0 part by weight Example 25

Fluoropolyether containing compound E (product name: Fluorolink (registered trademark, hereinafter the same) E10H): 1.0 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Example 26

Fluoropolyether containing compound F (product name: Fluorolink s10): 1.0 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Example 27

Fluoropolyether containing compound A (product name: Fomblin DA305): 0.005 parts by weight Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Example 28

Fluoropolyether containing compound B (product name: Fomblin DA306 VAC): 0.005 parts by weight Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Comparative Example 5

Lubricant oil Poly-α-olefin (kinetic viscosity (40° C.): 30 $mm^2/s$): 98.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Comparative Example 6

Detergent dispersant A Perbasic metal Ca sulfonate (viscosity (100° C.) 52 cSt): 1 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight Comparative Example 7

Detergent dispersant B Succinic acid imide (viscosity (100° C.) 570 cSt): 1 part by weight Lubricant oil Poly-α-olefin (kinetic viscosity (40° C.): 30 $mm^2/s$): 97.8 parts by weight Antioxidant Hindered phenol based antioxidant: 0.2 parts by weight Dust (type-1, type-2, type-7, and type-8 of JIS Z 8901 were mixed at a ratio of 1:1:1:1): 1.0 part by weight

TABLE 5

| | Example 19 | Example 20 | Example 21 | Example 22 | Example 23 | Example 24 |
|---|---|---|---|---|---|---|
| Fluoropolyether containing compound A | 1.0 | | | | | |
| Fluoropolyether containing compound B | | 1.0 | 0.01 | 5.0 | | |
| Fluoropolyether containing compound C | | | | | 1.0 | |
| Fluoropolyether containing compound D | | | | | | 1.0 |
| Lubricant oil | 97.8 | 97.8 | 98.8 | 64.8 | 97.8 | 97.8 |
| Antioxidant | 0.2 | 0.2 | 0.2 | 0.2 | 0.2 | 0.2 |
| Dust | 1.0 | 1.0 | 1.0 | 30.0 | 1.0 | 1.0 |
| Separation/Sedimentation of Dust | ○ | ○ | ○ | ○ | ○ | ○ |

TABLE 6

| | Example 25 | Example 26 | Example 27 | Example 28 |
|---|---|---|---|---|
| Fluoropolyether containing compound A | | | 0.005 | |
| Fluoropolyether containing compound B | | | | 0.005 |
| Fluoropolyether containing compound E | 1.0 | | | |
| Fluoropolyether containing compound F | | 1.0 | | |
| Lubricant oil | 97.8 | 97.8 | 98.8 | 98.8 |
| Antioxidant | 0.2 | 0.2 | 0.2 | 0.2 |
| Dust | 1.0 | 1.0 | 1.0 | 1.0 |
| Separation/Sedimentation of Dust | ○ | ○ | Δ | Δ |

TABLE 7

| | Comparative Example 5 | Comparative Example 6 | Comparative Example 7 |
|---|---|---|---|
| Lubricant oil | 98.8 | 97.8 | 97.8 |
| Detergent dispersant A | | 1.0 | |
| Detergent dispersant B | | | 1.0 |
| Antioxidant | 0.2 | 0.2 | 0.2 |
| Dust | 1.0 | 1.0 | 1.0 |
| Separation/Sedimentation of Dust | x | x | x |

The symbol "o" denoted in Table 5 to Table 7 indicates that separation and sedimentation of dust were observed at the bottom of the screw bottle. On the other hand, symbol "Δ" indicates that although separation and sedimentation of dust were observed at the bottom of the screw bottle, the amount of sedimentation of dust was smaller than that of the examples evaluated as "o" where the same amount of dust was added. Symbol "x" indicates that separation and sedimentation of dust were not observed at the bottom of the screw bottle.

Figure 12:
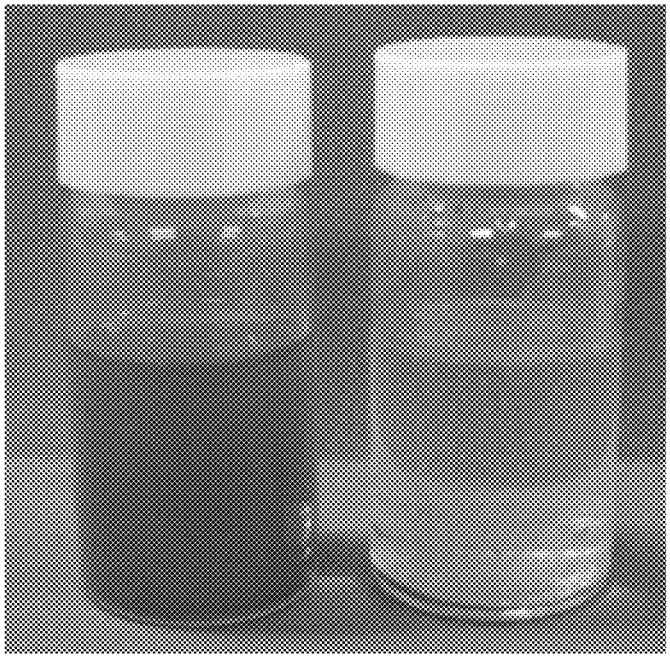
FIG. 12 is a photograph showing a mixed state of foreign substances in each sample of Comparative Example 5 and Example 19.
Figure 13:
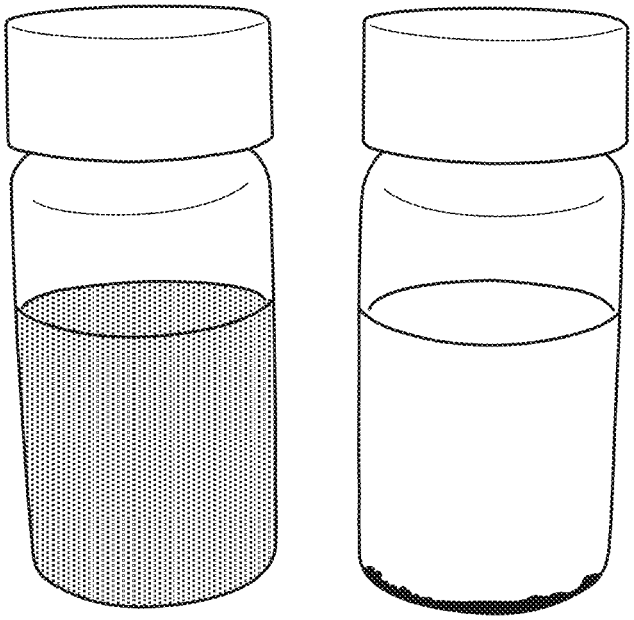
FIG. 13 is a schematic view of FIG. 12.

FIG. 12 is a photograph showing mixed states of foreign substances of each of the samples of Comparative Example 5 and Example 19. FIG. 13 is a schematic diagram of FIG. 12. The photograph and the schematic diagram on the left side in FIG. 12 and FIG. 13 respectively show a case of Comparative Example 5, and the photograph and the schematic diagram on the right side show a case of Example 19. As shown in FIG. 12 and FIG. 13, in Comparative Example 5, it was observed that the entire solution became murky and that foreign substances were not removed. The reason that the solution becomes murky as such is that, among the dust particles in JIS Z 8901, type-7 and type-8 particles having small particle sizes retain a mixed state within the lubricant oil. On the other hand, as shown in FIG. 12 and FIG. 13, the entire solution in Example 19 was in a translucent state, and it was confirmed that foreign substances were excluded from the lubricant oil and settled at the bottom. In Example 27 and Example 28 where "separation and sedimentation" shown in Table 6 were evaluated as "Δ", the amount of sedimentation of foreign substances was less compared to that of examples evaluates as "o".

Grease Types

Grease types of Example 29 to Example 31 and Comparative Example 8 were prepared with the formulations shown in the following Table 8. Raw materials used are as follows.

Example 29

Fluoropolyether containing compound A (product name: Fomblin DA 305): 1.0 part by weight Base oil Poly-α-olefin (kinetic viscosity (40° C.): 30 $mm^2/s$): 77.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 m): 5.0 parts by weight Dust (type-1, type-2, type-7, and type-8 of JIS Z 8901 were mixed at a ratio of 1:1:1:1): 2.0 parts by weight Example 30

Fluoropolyether containing compound B (product name: Fomblin DA306 VAC): 0.5 parts by weight Base oil Poly-α-olefin (kinetic viscosity (40° C.): 30 $mm^2$ s): 77.3 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 2.0 parts by weight Example 31

Fluoropolyether containing compound B (product name: Fomblin DA306 VAC): 10.0 parts by weight Base oil Poly-α-olefin (kinetic viscosity (40° C.): 30 $mm^2/s$): 67.8 parts by weight Thickener Lithium soap (12-lithium hydroxystearate): 7.0 parts by weight Antioxidant Hindered phenol based antioxidant: 0.2 parts by weight Solid lubricant A Polytetrafluoroethylene (average particle diameter 6.5 μm): 5.0 parts by weight Solid lubricant B Melamine cyanurate (average particle diameter 3.1 μm): 5.0 parts by weight Solid lubricant C Ultra high molecular weight polyethylene (average particle diameter 30 μm): 5.0 parts by weight Dust (type-1, type-2, type-7, and type-8 of JIS Z 8901 were mixed at a ratio of 1:1:1:1): 15.0 parts by weight Comparative Example 8

Base oil Poly-α-olefin (kinetic viscosity (40° C.): 30 $mm^2/s$): 79.8 parts by weight Thickener Lithium soap (12-lithium hydroxystearate): 10.0 parts by weight Antioxidant Hindered phenol based antioxidant: 0.2 parts by weight Solid lubricant D Ultra high molecular weight polyethylene (average particle diameter 10 μm): 10.0 parts by weight Dust (type-1, type-2, type-7, and type-8 of JIS Z 8901 were mixed at a ratio of 1:1:1:1): 2.0 parts by weight In the presence of a base oil, lithium soap was synthesized and the temperature was raised with stirring. Then, after cooling to 80° C. or lower, various additives were formulated and a uniform grease composition could be obtained by using a three-stage roll mill, a disper mill, a colloid mill or the like.

Worked penetration was adjusted between 280 and 310. Further, the test method is based on JIS K 2220. After adjusting the worked penetration, a prescribed amount of dust was mixed in the grease.

Method of Evaluating Grease

Since grease is a viscous substance, it cannot be evaluated by sedimentation of dust as in the case of a lubricant oil. Therefore, it was evaluated by friction coefficient.

Experiment Condition of Friction Coefficient

Test piece: PA 66 GF 30 pin (φ 4 mm)/Al plate

Load: 1000 gf

Grease coating thickness: 0.2 mm

Test temperature: Room temperature

Sliding speed: 10 mm/sec

Sliding width: 20 mm/one way

Number of slides: 10 reciprocated slides

A method of testing reciprocated slides is as described in FIG. 9.

For each sample, the kinetic friction coefficients before and after the addition of dust were measured, and the change rate of the friction coefficient was calculated by the following calculation formula.

That is, the kinetic friction coefficient after mixing dust after performing ten reciprocated slides was set as μ1, and the kinetic friction coefficient before mixing dust after performing ten reciprocated slides was set as μ0. Then, the change rate (%) of the friction coefficient was obtained by $\{(\mu 1-\mu 0)/\mu 0\}\times 100$. The experiment results are shown in Table 8 below.

TABLE 8

| | Example 29 | Example 30 | Example 31 | Comparative Example 8 |
|---|---|---|---|---|
| Fluoropolyether containing compound A | 1.0 | | | |
| Fluoropolyether containing compound B | | 0.5 | 10.0 | |
| Base oil | 77.8 | 77.3 | 67.8 | 79.8 |
| Lithium soap | 7.0 | 7.0 | 7.0 | 10.0 |
| Antioxidant | 0.2 | 0.2 | 0.2 | 0.2 |
| Solid lubricant A | 5.0 | 5.0 | 5.0 | |
| Solid lubricant B | 5.0 | 5.0 | 5.0 | |
| Solid lubricant C | 5.0 | 5.0 | 5.0 | |
| Solid lubricant D | | | | 10.0 |
| Dust | 2.0 | 2.0 | 15.0 | 2.0 |
| Change Rate | ○ | ○ | ○ | x |

Here, symbol "o" denoted in the "Change Rate" column shown in Table 8 indicates that the change rate is less than 40%, and symbol "x" indicates that the change rate is 40% or more.

As shown in Table 8, it was found that the change rate of the friction coefficient at the initial stage can be suppressed to less than 40% in the examples. Here, the friction coefficient was measured after performing reciprocated slides for 10 times. The reason for this is that, in the first several reciprocated slides, a sliding member and grease do not fit in with each other to cause large fluctuations in measurements of friction coefficients.

Next, using each of the samples of Example 29 and Comparative Example 8, the relationship between the number of reciprocated slides and the friction coefficient, when the sliding speed was changed to 10 mm/s, was studied. Further, experiment conditions for measuring the friction coefficients were the same except for the number of sliding speed and the number of slides mentioned above.

Figure 14:
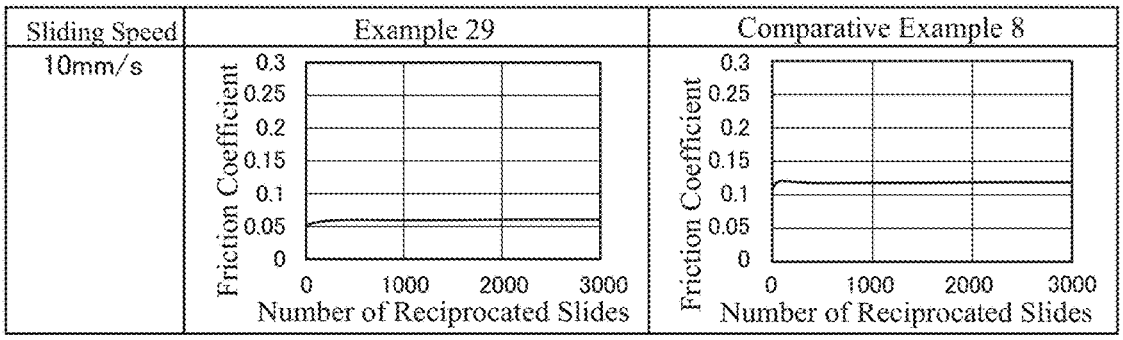
FIG. 14 shows graphs showing relationships between the number of reciprocated slides and the friction coefficient for each sliding speed of Example 29 and Comparative Example 8 in a state not containing foreign substances.

FIG. 14 shows graphs showing relationships between the number of reciprocated slides and the friction coefficient for the sliding speed of Example 29 and Comparative Example 8 in a state not containing foreign substances. On the other hand, FIG. 15 shows graphs showing relationships between the number of reciprocated slides and the friction coefficient for the sliding speed of Example 29 and Comparative Example 8 in a state containing foreign substances.

As shown in FIG. 14, it was found that the friction coefficient does not significantly change depending on the sliding speed in both Example 29 and Comparative Example 8 in a state free of foreign substances, but that the friction coefficient can be suppressed low in Example 29 better than in Comparative Example 8.

Figure 15:
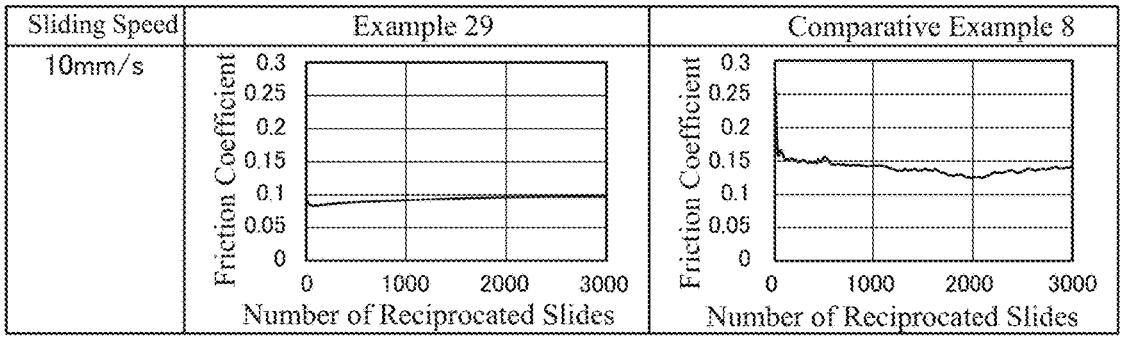
FIG. 15 shows graphs showing relationships between the number of reciprocated slides and the friction coefficient for each sliding speed of Example 29 and Comparative Example 8 in a state containing foreign substances.

Next, as shown in FIG. 15, it was found that the friction coefficient does not significantly change depending on the sliding speed in Example 29 even in a state having foreign substances. In contrast, in Comparative Example 8, it was found that the friction coefficient becomes unstable particularly as the sliding speed becomes lower.

INDUSTRIAL APPLICABILITY

The foreign substance removing lubricant composition according to the present invention can be preferably applied to automobile parts such as a door lock mechanism, window regulator, seat rail, and sunroof, and as a lubricant oil or grease of a member having a sliding part in various devices.

The present application is based on Patent Application No. 2016-013501 filed on Jan. 27, 2016, and Patent Application No. 2016-039081 filed on Mar. 1, 2016. All contents thereof are included herein.

The invention claimed is:

1. A foreign substance removing lubricant composition comprising:

a perfluoroalkyl group-containing compound having a perfluoroalkyl group, and a lubricant component including lubricant oil or grease;

the perfluoroalkyl group-containing compound being represented by the following formula (4), (4)

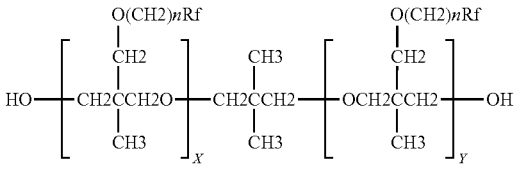

wherein n is an integer 1-2, Rf is a perfluoroalkyl group with a carbon number of 2-4, X and Y are integers greater than or equal to 1, and X+Y is an integer in a range of 4-20.

2. The foreign substance removing lubricant composition according to claim 1, wherein the lubricant component is selected from at least any one of a mineral oil, synthetic hydrocarbon oil, diester oil, polyol ester oil, ether oil, glycol oil, silicone oil, and fluorine oil.

3. The foreign substance removing lubricant composition according to claim 1, wherein a thickener contained in the grease is selected from at least any one of lithium soap, calcium soap, sodium soap, aluminum soap, lithium complex soap, calcium complex soap, aluminum complex soap, urea compound, organified bentonite, polytetrafluoroethylene, silica gel, and sodium terephthalamate.

4. The foreign substance removing lubricant composition according to claim 1, wherein sedimentation of foreign substances having at least type-7 or type-8 prescribed in JIS Z 8901 is observed, when the foreign substances are added to the foreign substance removing lubricant composition comprising the perfluoroalkyl group containing compound, and the lubricant oil.

5. The foreign substance removing lubricant composition according to claim 1, wherein a friction coefficient measured by adding foreign substances having at least type-1 or type-2 prescribed in JIS Z 8901 to the foreign substance removing lubricant composition comprising the perfluoroalkyl group containing compound, and the lubricant component of the grease, is small compared to a friction coefficient of the lubricant composition not containing the perfluoroalkyl group containing compound, but having the foreign substances added thereto.

6. The foreign substance removing lubricant composition according to claim 1, wherein a change rate (%) of the friction coefficient shown by $\{(\mu 1-\mu 0)/\mu 0\}\times 100$ is less than 45% when $\mu 1$ is a friction coefficient at the initial stage measured by adding foreign substances having at least type-1 or type-2 prescribed in JIS Z 8901 to the foreign substance removing lubricant composition comprising the perfluoroalkyl group containing compound and the lubricant component of the grease, and $\mu 0$ is a friction coefficient at the initial stage measured without adding the foreign substances.

7. The foreign substance removing lubricant composition according to claim 1, wherein a change rate (%) of the friction coefficient shown by $\{(\mu 1-\mu 0)/\mu 0\}\times 100$ is less than 40% when $\mu 1$ is a friction coefficient at the initial stage measured by adding foreign substances having at least type-1 or type-2 prescribed in JIS Z 8901 to the foreign substance removing lubricant composition comprising the fluoropolyether containing compound and the lubricant component of the grease, and $\mu 0$ is a friction coefficient at the initial stage measured without adding the foreign substances.

8. A foreign substance removing lubricant composition, wherein the foreign substance removing lubricant composition according to claim 1 is placed in an environment containing dust.

9. The foreign substance removing lubricant composition according to claim 8, wherein the dust has a volume ratio of 50% or less of the foreign substance removing lubricant composition.

10. The foreign substance removing lubricant composition according to claim 8, wherein the dust contains $SiO_2$ as a main component.

11. A foreign substance removing lubricant composition applied member, wherein the foreign substance removing lubricant composition according to claim 1 is applied on a member, and the member is placed in an environment containing dust.

12. A method for using a foreign substance removing lubricant composition, wherein the foreign substance removing lubricant composition according to claim 1 is applied on a member, and the member is used in an environment containing dust.

* * * * *